US012649616B2

(12) United States Patent
Kobashi et al.

(10) Patent No.: US 12,649,616 B2
(45) Date of Patent: Jun. 9, 2026

(54) DOUBLE CONTAINER, METHOD FOR ATTACHING REFILL IN DOUBLE CONTAINER, AND CONNECTING PART

(71) Applicant: SHISEIDO COMPANY, LTD., Tokyo (JP)

(72) Inventors: Yoshihiko Kobashi, Tokyo (JP); Tsuyoshi Sasaki, Tokyo (JP); Kosuke Otaka, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 55 days.

(21) Appl. No.: 18/727,489

(22) PCT Filed: Feb. 8, 2023

(86) PCT No.: PCT/JP2023/004234
§ 371 (c)(1),
(2) Date: Jul. 9, 2024

(87) PCT Pub. No.: WO2023/157736
PCT Pub. Date: Aug. 24, 2023

(65) Prior Publication Data

US 2025/0091784 A1 Mar. 20, 2025

(30) Foreign Application Priority Data

Feb. 16, 2022 (JP) ..... 2022-022377

(51) Int. Cl.
*B65D 77/04* (2006.01)

(52) U.S. Cl.
CPC ..... *B65D 77/0493* (2013.01)

(58) Field of Classification Search
CPC ..... B65D 51/18; B65D 2251/0003; B65D 2251/0006; B65D 77/0493; B65D 83/771;
(Continued)

(56) References Cited

U.S. PATENT DOCUMENTS 4,915,255 A * 4/1990 Curtis ..... A61B 10/0096 206/521
5,328,056 A * 7/1994 Schneider ..... B65D 35/22 222/94

(Continued)

FOREIGN PATENT DOCUMENTS

CN 113928677 1/2022
EP 3747550 12/2020

(Continued)

OTHER PUBLICATIONS

International Search Report for PCT/JP2023/004234 mailed on Mar. 20, 2023.

(Continued)

*Primary Examiner* — Kareen K Thomas
(74) *Attorney, Agent, or Firm* — IPUSA, PLLC

(57) ABSTRACT

Invention's double container 100 includes: inner container 1 including mouth and shoulder parts; outer container 2 having side wall and accommodating inner container 1 replaceably; two-stage tube-shaped first connecting member 4 having opening through which inner container 1's mouth part can be inserted, and threadedly engageable with outer surface of outer container's side wall while covering inner container's shoulder part and side wall's upper end; and approximately tube-shaped second connecting member 5 having opening through which inner container's mouth part can be inserted and situated inside first connecting member. Second connecting member 5 includes: inner-circumference rotation restricting part 57 contacting part of inner container 1's mouth part 14 to restrict rotation relative to mouth part; and outer-circumference rotation restricting part 52 contacting part of outer container 2's side wall to restrict rotation relative to outer container 2. When assembled, inner container is restricted from rotation relative to outer container 2.

10 Claims, 15 Drawing Sheets

(58) Field of Classification Search
CPC ..... B05B 11/0054; B05B 11/1047; B05B 11/0038
See application file for complete search history.

(56) References Cited

U.S. PATENT DOCUMENTS

| | | | | |
|---|---|---|---|---|
| 6,085,927 | A * | 7/2000 | Kusz | B65D 77/0493 220/592.28 |
| 6,176,395 | B1 * | 1/2001 | Abbott | B29C 65/58 222/153.09 |
| 6,997,353 | B2 * | 2/2006 | Decottignies | B05B 11/046 222/105 |
| 7,435,027 | B2 * | 10/2008 | Hetzel | B65D 35/22 401/47 |
| 7,934,624 | B2 * | 5/2011 | Seelhofer | B65D 81/3227 222/129 |
| 2008/0308558 | A1 * | 12/2008 | Potts | B65D 47/12 220/502 |
| 2011/0272410 | A1 | 11/2011 | Sato et al. | |
| 2020/0376510 | A1 | 12/2020 | Erlhöfer | |
| 2023/0013434 | A1 | 1/2023 | Kim et al. | |
| 2023/0022130 | A1 | 1/2023 | Lee et al. | |

FOREIGN PATENT DOCUMENTS

| | | |
|---|---|---|
| JP | H05-075163 U | 10/1993 |
| JP | 2008-007160 | 1/2008 |
| JP | 2008-087768 | 4/2008 |
| JP | 2016-159934 | 9/2016 |
| WO | 2010/087408 | 8/2010 |
| WO | 2021/125513 | 6/2021 |
| WO | 2021/187718 | 9/2021 |

OTHER PUBLICATIONS

Extended European Search Report issued in European Application No. 23756262.4, mailed on May 19, 2025.

* cited by examiner

Related Art 1

DOUBLE CONTAINER, METHOD FOR ATTACHING REFILL IN DOUBLE CONTAINER, AND CONNECTING PART

TECHNICAL FIELD

The present invention relates to a double container, a method for attaching a refill in a double container, and a connecting part used for connecting the double container.

BACKGROUND ART

In recent years, from the viewpoint of reducing resins used as container materials, containers for various applications have been increasingly reduced in thickness or have been being formed in a film shape. However, since inner containers reduced in thickness alone cannot help reduction in the content and cannot keep themselves self-standing, double containers in which inner containers (refill containers) reduced in thickness and outer containers that can be used repeatedly are combined are being popularized.

As an example of such a double container, PTL 1 discloses a configuration including an outer cap 83 configured to be screw-threadedly engaged with the upper end of the side wall of a tubular outer container 82 while pressing a flange 811 of an inner container 81 from above, to thereby facilitate engagement between the inner container 81 and the outer container 82.

However, according to the configuration of PTL 1, pressing the flange 811 from above is the only action that is applied by the outer cap 83 to the inner container 81. Therefore, when removing a mouth cap 85, which is a pumping outlet through which a pump mechanism 84 is inserted, by rotating the mouth cap relative to the inner container 81, the inner container 81 may rotate conjunctively with the mouth cap 85 and the mouth cap 85 may not loosen open, if the outer container 82 is held in a grasping manner.

As illustrated in FIG. 2, PTL 2 discloses a technique relating to a double container, in which an inner container 90 includes above a containing part 91, a fit-in tube 92 as an outwardly overhanging integrated part, wherein the fit-in tube has a bend part 93 configured to inhibit conjunctive rotation of the inner container 90 and a cap 99 that is engaged with a mouth part 94.

CITATION LIST

Patent Literature

[PTL 1] Japanese Utility Model Application Laid-Open Publication No. H5-075163

[PTL 2] Japanese Patent Application Laid-Open Publication No. 2008-87768

SUMMARY OF THE INVENTION

Technical Problem

Here, in a double container in which an inner container is prepared as a refill, an inner container is replaced with a new inner container (refill container) and discarded when its content is used up, whereas the outer container is repeatedly used. When the inner container includes, as an integrated part, a fit-in tube 92 having a bend part as in PTL 2, the amount of refill-side resin that is discarded without being repeatedly used after the content is exhausted increases.

In view of the above circumstances, an object of the present invention is to provide a double container that can inhibit conjunctive rotation of an inner container and a cap, while minimizing the amount of resins used in a refill inner container.

Solution to the Problem

In order to solve the above problems, one aspect of the present invention provides a double container, including:

- an inner container including a mouth part and a shoulder part;
- an outer container having a side wall, the outer container being configured to accommodate the inner container in a replaceable manner;
- a first connecting member having a two-stage tube shape, the first connecting member having an opening through which the mouth part of the inner container can be inserted, and the first connecting member being configured to be threadedly engaged with an outer surface of the side wall of the outer container while covering the shoulder part of the inner container and an upper end of the side wall; and
- a second connecting member having an approximately tube shape, the second connecting member having an opening through which the mouth part of the inner container can be inserted, and the second connecting member being situated on an inner side of the first connecting member, wherein the second connecting member includes:

- an inner-circumference rotation restricting part configured to contact a part of the mouth part of the inner container to restrict rotation relative to the mouth part; and
- an outer-circumference rotation restricting part configured to contact a part of the side wall of the outer container to restrict rotation relative to the outer container, and in an assembled state, the inner container is restricted from rotation relative to the outer container.

Advantageous Effects of the Invention

According to one aspect, a double container can inhibit conjunctive rotation of a cap and an inner container while minimizing the amount of resins used in the refill inner container.

DETAILED DESCRIPTION OF THE INVENTION

Figure 1:
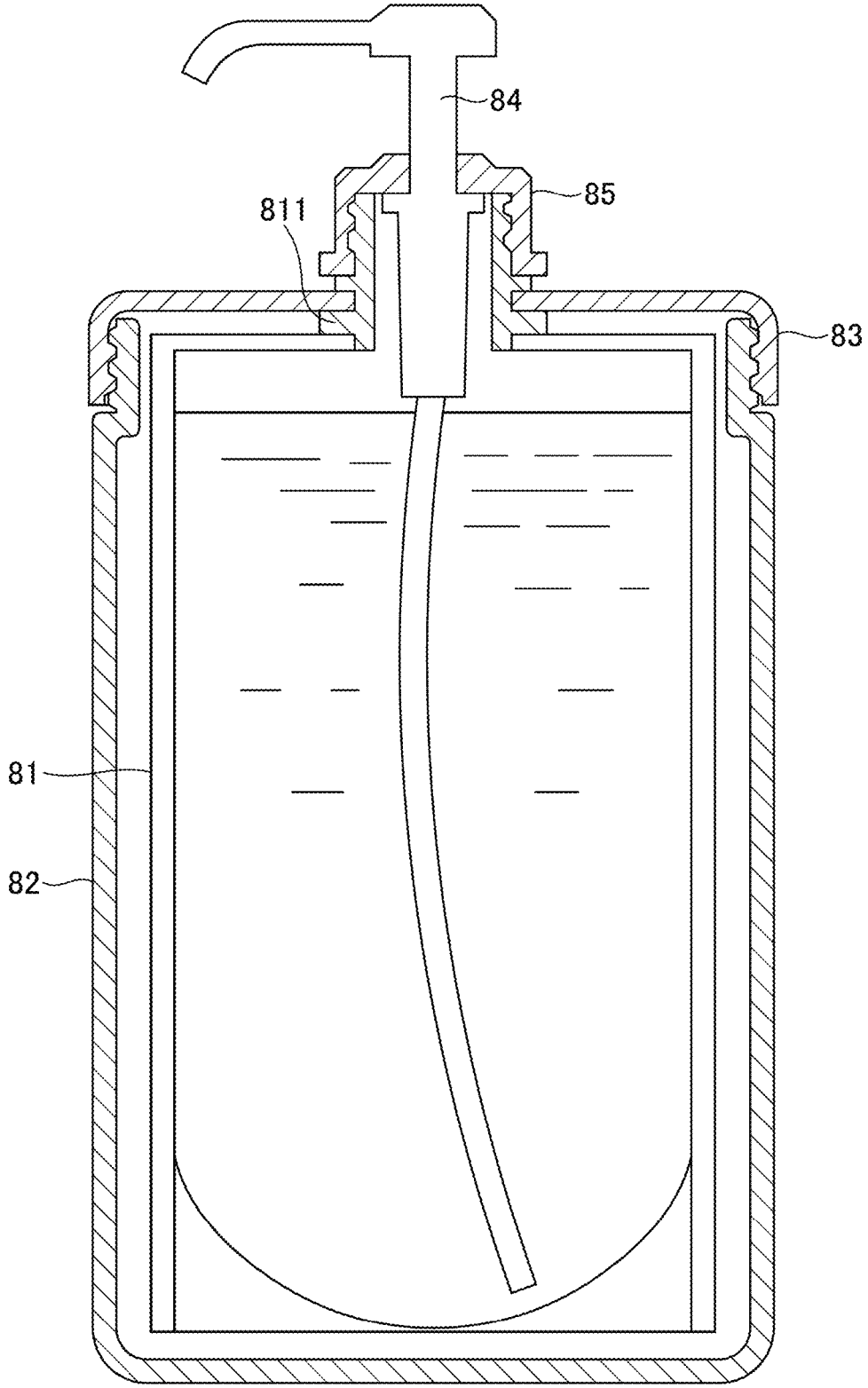
FIG. 1 is a cross-sectional view of the double container according to Related Art 1.
Figure 2:
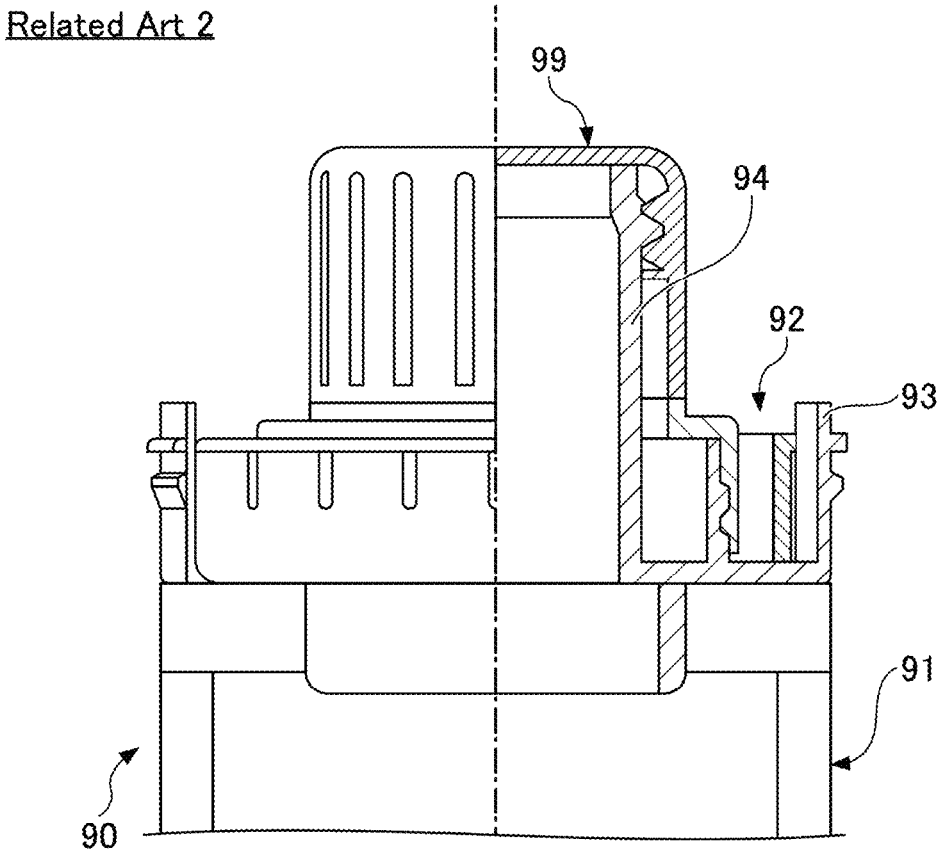
FIG. 2 is a half cross-sectional view of the inner container of the double container according to Related Art 2.

An embodiment for carrying out the present invention will now be described with reference to the drawings. In the following description, the same components in the drawings may be denoted by the same reference numerals and duplicate descriptions may be omitted.

The present invention relates to a double container, a method for attaching a refill in a double container, and a connecting part included in the double container. An inner container of the double container is a container made of a resin or paper, and may be a self-standing type or a non-self-standing type. An outer container of the double container is a self-standing container made of glass, wood, resin, silicon, metal, and the like.

It is preferable that the content to be contained in the inner container held by the outer container of the double container according to the present invention is a liquid or powder substance that is used dividedly in several portions such as a cosmetic material, a fragrance, a detergent, a seasoning, and the like, rather than something that is for one-time serving.

<Overall Structure of the Double Container>

Figure 3:
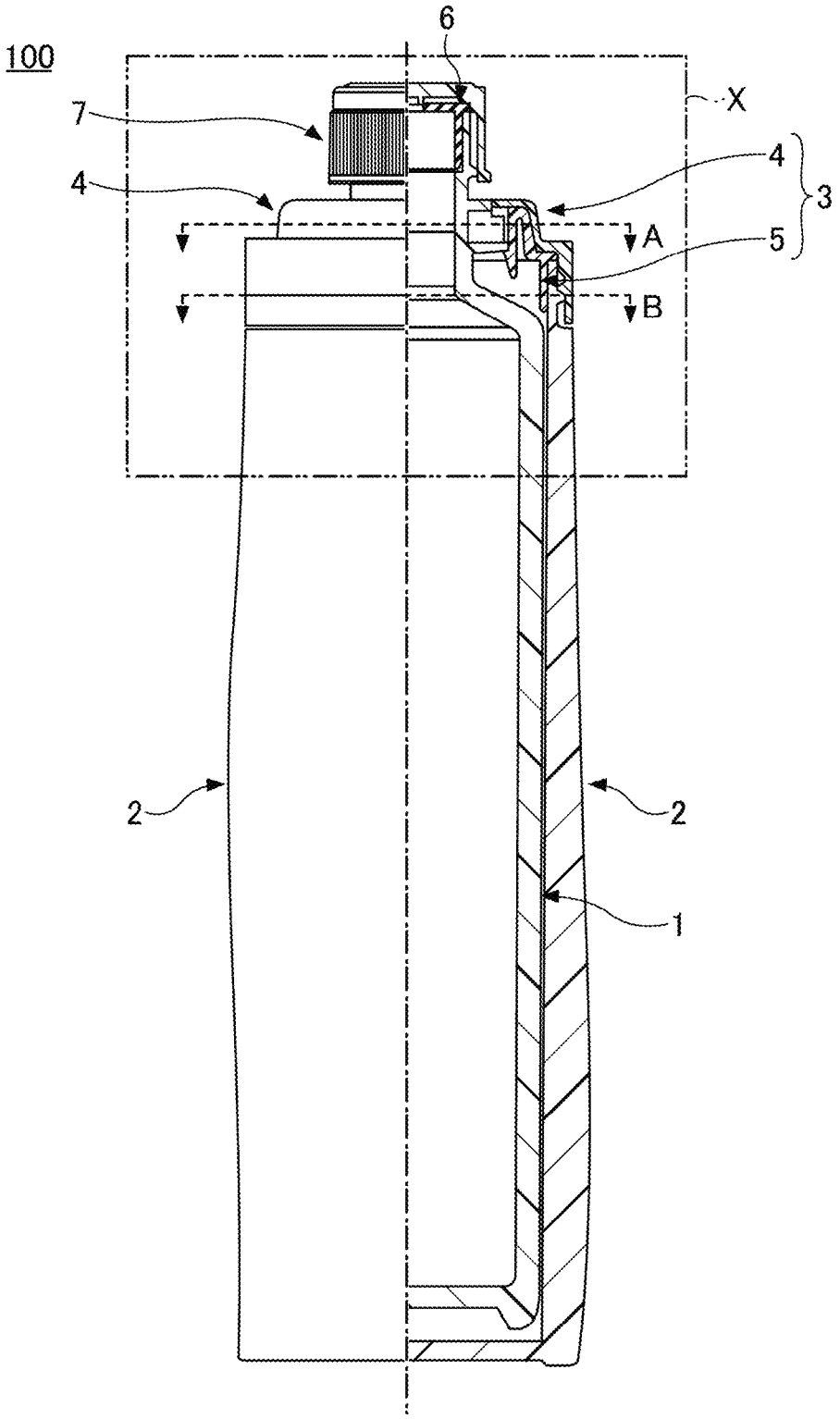
FIG. 3 is a half cross-sectional view of a double container according to an embodiment of the present invention.
Figure 4:
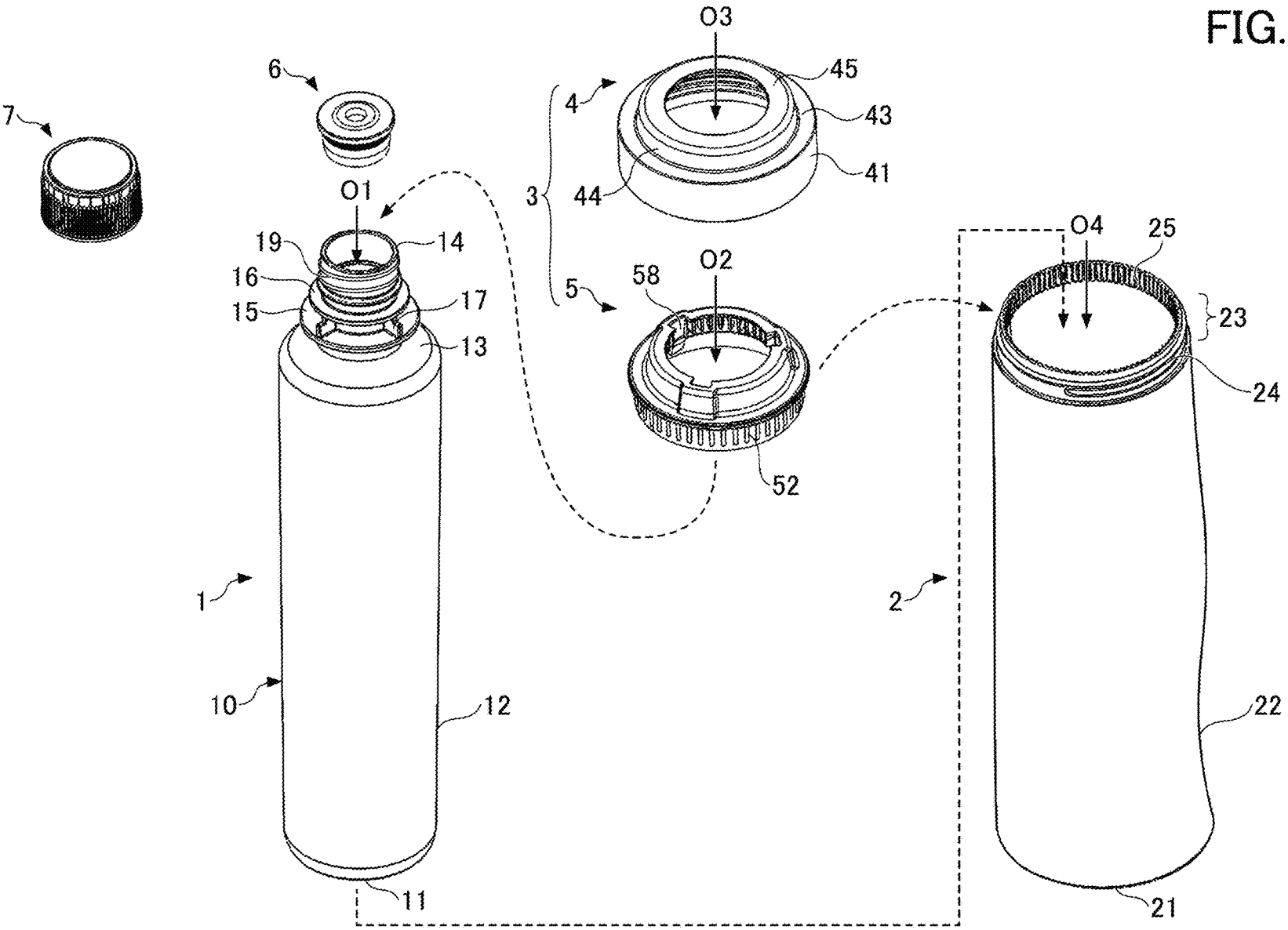
FIG. 4 is an exploded view of the double container of FIG. 2.

First, a schematic configuration of the double container of the present invention will be described with reference to FIGS. 3 and 4. FIG. 3 is a view illustrating a double container according to an embodiment of the present invention. Specifically, FIG. 3 is a half cross-sectional view of the double container, the left side illustrates an external view, and the right side illustrates a cross-sectional view. FIG. 4 is an exploded view of the double container of FIG. 3.

As illustrated in FIGS. 3 and 4, a double container 100 according to the present embodiment includes an inner container 1, an outer container 2, and a connecting part 3 as main parts. The connecting part 3 includes two parts, namely a first connecting member 4 and a second connecting member 5. The double container 100 also includes an inner plug 6 and a cap 7 as accessory parts.

The inner container 1 includes a bottle body 10 for containing a content and a mouth part 14. The bottle body (also referred to as a bottle part or a containing part) 10 has a bottomed tube shape having a bottom 11 and a trunk 12, and has a shoulder part 13 having a center hole O1 in the center of the upper surface. The mouth part 14 of the inner container 1 is a standing tubular part standing upright on the rim of the center hole O1 formed in the shoulder part 13 of the bottle body 10.

The inner container 1 is made of, for example, a resin or paper. The resin of which the inner container 1 is made is composed of, for example, polypropylene (PP), polyethylene (PE), acrylonitrile-butadiene-styrene (ABS), polybutylene terephthalate (PBS), polyacetal (POM), polyester-based resins such as polyethylene terephthalate (PET), biodegradable resins, and the like. Alternatively, the paper of which the inner container 1 is made is, for example, a laminate using paper as a base material.

The outer container 2 is a bottomed tube-shaped self-standing container with an opening O4 formed at the upper end, wherein the outer container is configured to accommodate the inner container 1 in a replaceable manner, and serves as an outer container that is on the outer side in the double container 100. The outer container 2 has a bottom 21 and a side wall (outer wall) 22. The side wall 22 includes an upper-end thin side wall 23 at the upper end thereof. The upper-end thin side wall 23 has screw threads 24 on the outer surface thereof, and has a jagged surface 25, in which a plurality of indentations extending in the longitudinal direction are formed, on the inner surface thereof. The inner jagged surface 25 is a rotation restricting part of the outer container 2.

The outer container 2 of the present invention is made of, for example, resin, glass, wood, silicon, metal, paper, and the like. In a case of resin, the outer container 2 is made of, for example, resin such as PP, PE, ABS, PBS, POM, PET, or polyester-based resins, biodegradable resins, and the like, similarly to the inner container 1 described above. Examples of wood include: wood of needle-leaf trees such as cedar, cypress, pine, and the like; wood of broad-leaf trees such as oak, walnut, black cherry, alder, rubberwood, and the like; and bamboo. An example of paper is self-standing cardboard.

The first connecting member 4 of the connecting part 3 is a two-stage tube-shaped member and has an opening O3 that is larger than the outer diameter of the mouth part 14 and through which the mouth part of the inner container can be inserted. As illustrated in FIG. 3, the first connecting member 4 is a cover member configured to be threadedly engaged with the outer surface of the side wall 22 of the outer container 2 while covering the shoulder part 13 of the inner container 1.

The second connecting member 5 of the connecting part 3 is an approximately tube-shaped rotation restricting member that has an opening O2, through which an upper part of the mouth part 14 of the inner container 1 is inserted, and that is situated on the inner side of the first connecting member 4. The second connecting member 5 can be engaged with the first connecting member 4 while being restricted from rotation relative to it. The second connecting member 5 can also be engaged with a part of the mouth part 14 of the inner container 1 while being restricted from rotation relative to it.

The first connecting member 4 and the second connecting member 5 are made of resin such as, for example, PP, PE, ABS, PBS, POM, PET, or polyester-based resins, biodegradable resins, and the like.

The inner plug 6 is a discharge amount adjusting part that is attached in the center hole O1 of the mouth part 14 of the inner container 1, and in which a discharge port for discharging the content in an adequate amount is formed. The inner plug 6 is made of, for example, elastic rubber or resin (for example, PP, PE).

The cap 7 is a capping part of the inner container 1, and is configured to cover the upper part and the circumference of the mouth part 14 of the inner container 1. The cap 7 is made of, for example, resin such as PP, PE, ABS, PBS, POM, PET, or polyester-based resins, a biodegradable resin, and the like. 25

(Connecting Part)

Figure 5:
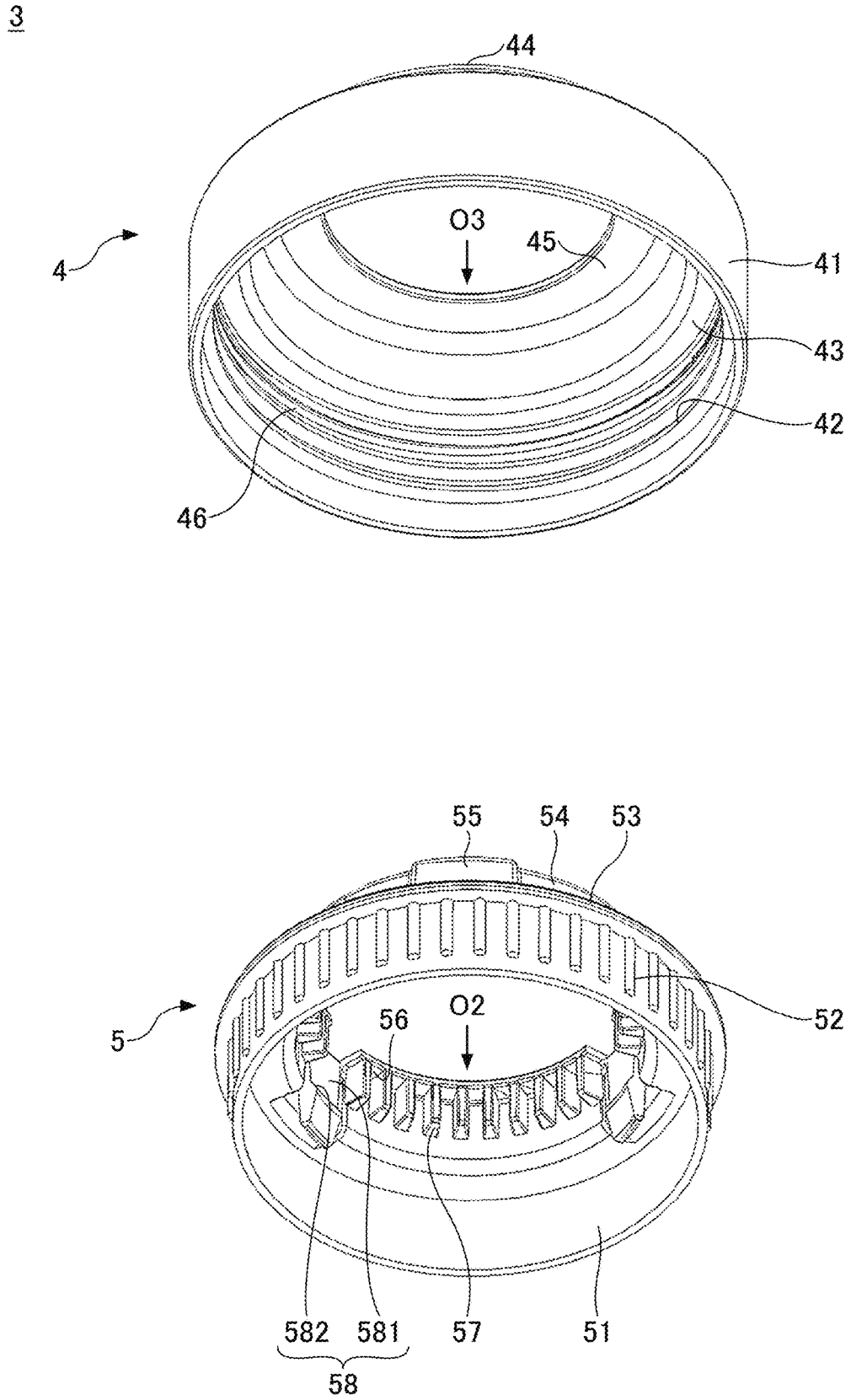
FIG. 5 is an oblique exploded bottom view of a connecting part.
Figure 6:
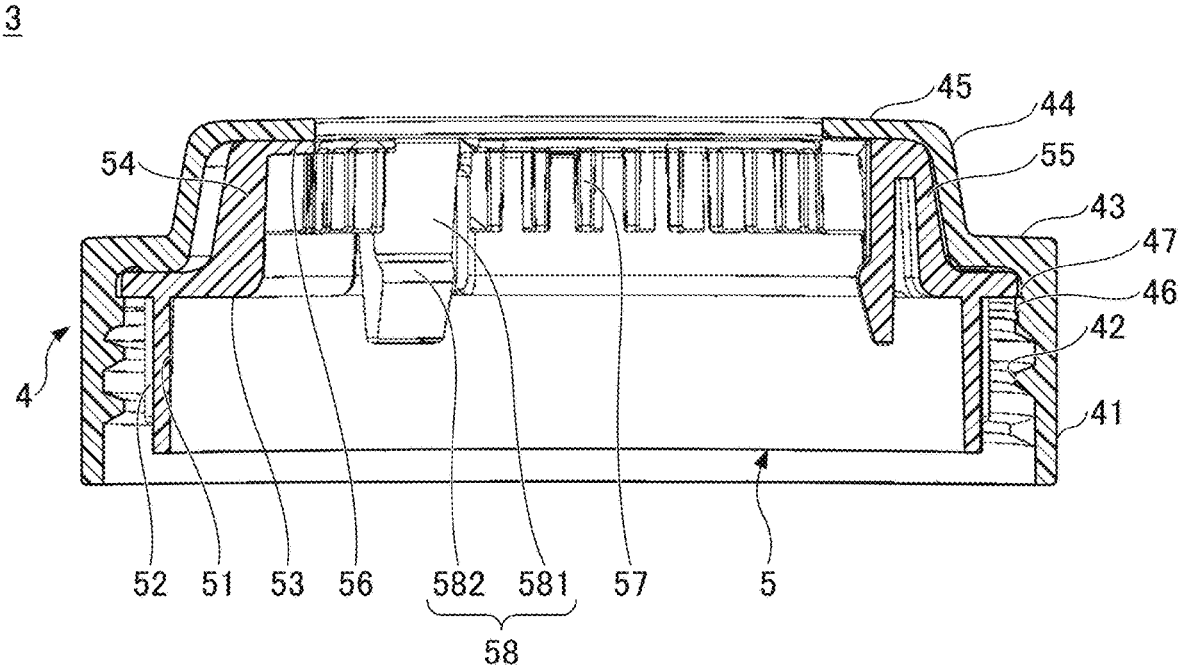
FIG. 6 is a cross-sectional view of the connecting part.

FIG. 5 is an oblique exploded bottom view of the connecting part 3. FIG. 6 is a cross-sectional view of the connecting part 3. The configuration of the connecting part will be described with reference to FIGS. 4 to 6.

The first connecting member 4 has an outer tube 41, an outer annular plate 43, an upright tube 44, and an upper-end ring 45. The first connecting member 4 has a two-stage tube shape including: the outer tube 41 having a larger diameter; and the upright tube 44 having a smaller diameter.

The outer tube 41 is an outer tubular part that can be threadedly engaged with the outer container 2, and screw threads 42 are provided on the inner circumferential surface of the outer tube 41. The screw threads 42 of the outer tube 41 are threadedly engaged with the screw threads 24 of the outer container 2. Further, an annular projection 46 is provided on the inner circumferential surface of the outer tube 41 above the screw threads 42. A portion sandwiched between the annular projection 46 and the lower surface of the outer annular plate 43 at the upper end of the inner circumferential surface of the outer tube 41 is a fitting groove 47 (see FIG. 6).

The outer annular plate 43 is an annular plate extending inward from the upper end of the outer tube 41 so as to reduce the diameter of the outer tube. The upright tube 44 stands upright on the inner rim of the outer annular plate 43. The upper-end ring 45 is a small-diameter upper-end annular plate extending inward from the upper end of the upright tube 44 so as to reduce the diameter of the upright tube.

The second connecting member 5 includes a fit-in tube 51, an annular support plate 53, an upright tube 54, an upper-end diameter-reducing ring 56, and a plurality of locking hooks 58. Outer ribs 52 are formed on the outer circumferential surface of the fit-in tube 51. A plurality of inner ribs 57 are provided on the inner circumferential surface of the upright tube 54 under the upper-end diameter-reducing ring 56.

In the second connecting member 5, the upright tube 54 stands upright on the inner rim of the annular support plate 53, which is an annular plate, and the fit-in tube 51 is suspended from the lower surface of the annular support plate 53 at a position that is slightly on the inner side of the outer rim of the annular support plate. The outer rim of the annular support plate 53 is located on the outer side of the upper end of the fit-in tube 51.

Regions of the upright tube 54 that face the locking hooks 58 are arc-shaped diameter-increasing regions 55 located at positions that are more outward than the remaining regions of the upright tube. The upper-end diameter-reducing ring 56 is a small-diameter upper-end annular plate extending inward from the upper end of the upright tube 54 and from the upper ends of the diameter-increasing regions 55 so as to reduce their diameters.

The plurality of linear outer ribs 52 provided on the outer surface of the lower fit-in tube 51 of the second connecting member 5 are an outer-circumference rotation restricting part configured to restrict rotation relative to the outer container 2. On the other hand, the inner ribs 57 provided on the inner surface of the upper upright tube 54 are an inner-circumference rotation restricting part configured to restrict rotation relative to the inner container 1, and include a plurality of plate-shaped ribs. The inner-circumference rotation restricting part and the outer-circumference rotation restricting part of the second connecting member 5 may be structured in other forms, and, for example, different numbers of linear ribs may be provided, or the inner surface or the outer surface may have a polygonal cross-sectional shape.

As illustrated in FIG. 6, the locking hooks 58 are elastic engaging pieces that are suspended in a cantilever-like manner from the inner rim of the upper-end diameter-reducing ring 56, which constitutes the upper end, and have an outward spring property. The locking hooks 58 each include an extending part 581 that extends in the vertical direction, and a locking projection 582 that is provided about the lower end of the inner surface of the extending part 581 and projects inward.

The plurality of locking hooks 58 are provided in the circumferential direction. FIGS. 4 and 5 illustrate an example in which three locking hooks 58 are provided, but the locking hooks 58 may be provided in any plural number.

During manufacture of the connecting part 3, thrusting the second connecting member 5 with a strong force against the first connecting member 4 from beneath causes the annular support plate 53 of the second connecting member 5 to climb past the annular projection 46, and then causes the outer rim of the annular support plate 53 of the second connecting member 5 to become fitted into the fitting groove 47 that serves as an inner boundary between the outer tube 41 and the outer annular plate 43 of the first connecting member 4 (see the cross-sectional view of FIG. 6). Thus, after the first connecting member 4 and the second connecting member 5 are engaged with each other, the second connecting member 5 is fixed unmovable in the vertical direction relative to the first connecting member 4.

In the state of the connecting part 3 illustrated in FIG. 6, the lower surface of the upper-end ring 45 of the first connecting member 4 and the upper surface of the upper-end diameter-reducing ring 57 of the second connecting member 5 are in contact with each other, and the inner surface of the upright tube 44 and the outer surfaces of the diameter-increasing regions 55 are in contact with each other.

In this state of the connecting part 3, many parts of the first connecting member 4 and the second connecting member 5, i.e., (the fitting groove 47 and the outer rim of the annular support plate 53), (the lower surface of the upper-end ring 45 and the upper surface of the upper-end diameter-reducing ring 57), and (the inner surface of the upright tube 44 and the outer surfaces of the diameter-increasing regions 55) are in snug contact with each other. Therefore, in the connecting part 3 before the double container assembly, the second connecting member 5 can rotate relative to the first connecting member 4 while being under a moderate resistance owing to friction over the wide contact area.

(Shape of the Mouth Part of the Inner Container)

Figure 7:
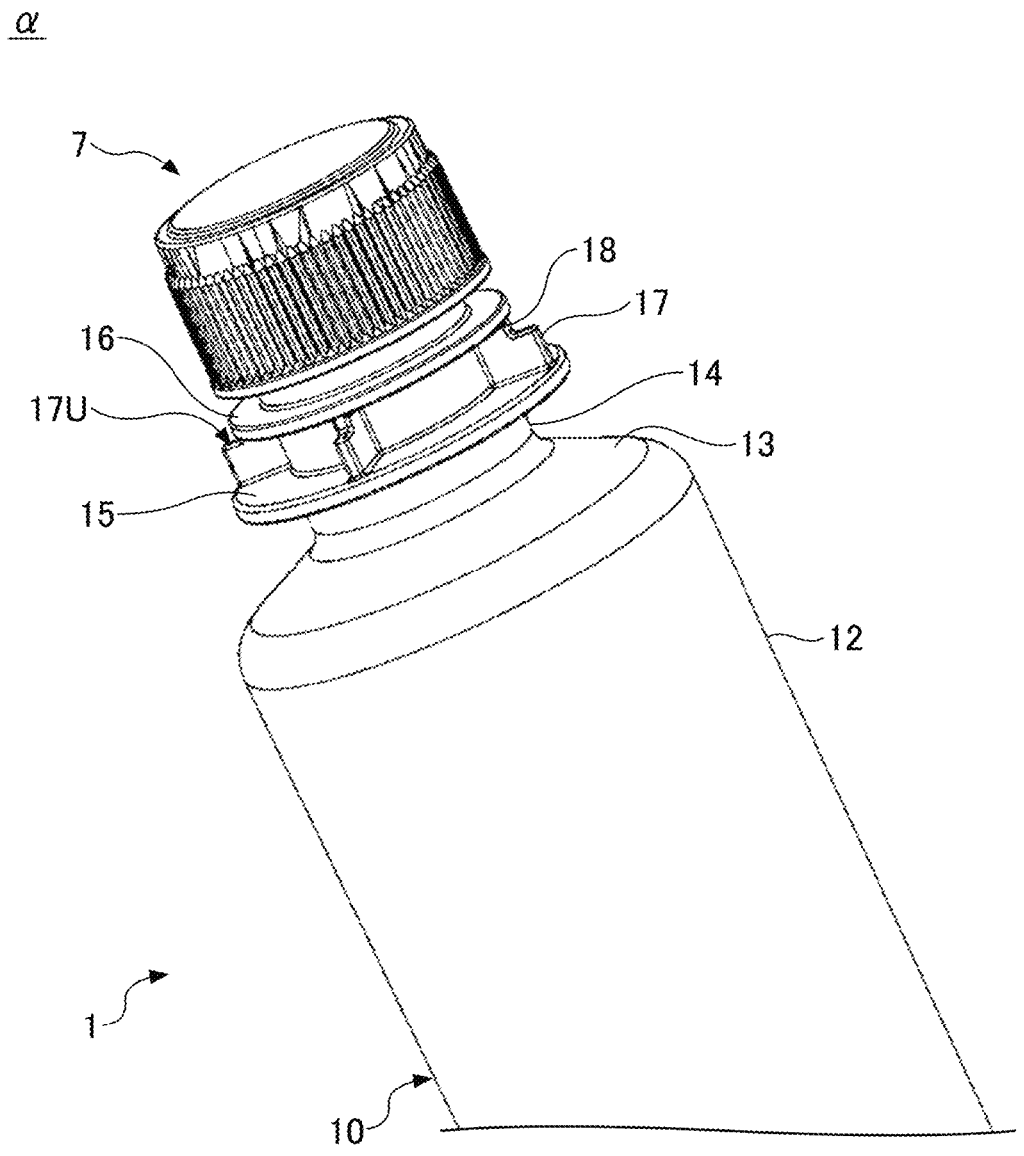
FIG. 7 is an oblique view of a mouth part of an inner container and its surroundings.

FIG. 7 is an oblique view of the mouth part 14 of the inner container 1 and its surroundings. The outer circumferential surface of the tubular mouth part 14 of the inner container 1 is provided with a lower flange 15, an upper flange 16, a plurality of plate-shaped ribs 17 and 18, and screw threads 19 (see FIG. 4).

The lower flange 15 and the upper flange 16 are annular members extending outward from the outer circumferential surface of the mouth part 14. The outer diameter of the outer rim of the lower flange 15 is larger than that of the upper flange 16.

The plurality of plate-shaped ribs 17 and 18 are plate-shaped ribs that are continuous in the vertical direction so as to be continuously joined with the lower flange 15 and the upper flange 16, and provided so as to extend outward from the outer circumferential surface of the mouth part 14. Of the plate-shaped ribs, the lower one is the lower rib 17 projecting long, and the upper one is the upper rib 18 projecting short. The upper rib 18 extends outward by the same length as the upper flange 16, and the lower rib 17 extends outward slightly shorter than the lower flange 15 and longer than the upper rib 18, such that the upper rib 18 and the lower rib 17 are bounded as a step. The upper end of the lower rib 17, which constitutes the step, is a rib top 170.

Of the mouth part 14, the lower flange 15 and the rib top 170 of the lower rib 17 function as a position restricting part.

The lower rib 17 is a mouth part rotation restricting part of the inner container 1, and is configured to contact the inner ribs 57 of the second connecting member 5 to restrict rotation of the inner container 1 and the second connecting member 5 relative to each other.

The upper flange 16 is an intrusion inhibiting member configured to inhibit the content from intruding into the connecting part 3, and the upper rib 18 is a member configured to adjust the connecting part 3 so as not to be inclined in the thickness direction during assembly.

Here, the inner container (refill container) 1 and the cap 7, which are illustrated in FIG. 7, and the inner plug 6 provided on an as-needed basis, form a refill a replaceable together with its content, as opposed to the outer container 2, the first connecting member 4, and the second connecting member 5 of the double container 100.

(Upper-End Structure of the Outer Container)

Figure 8:
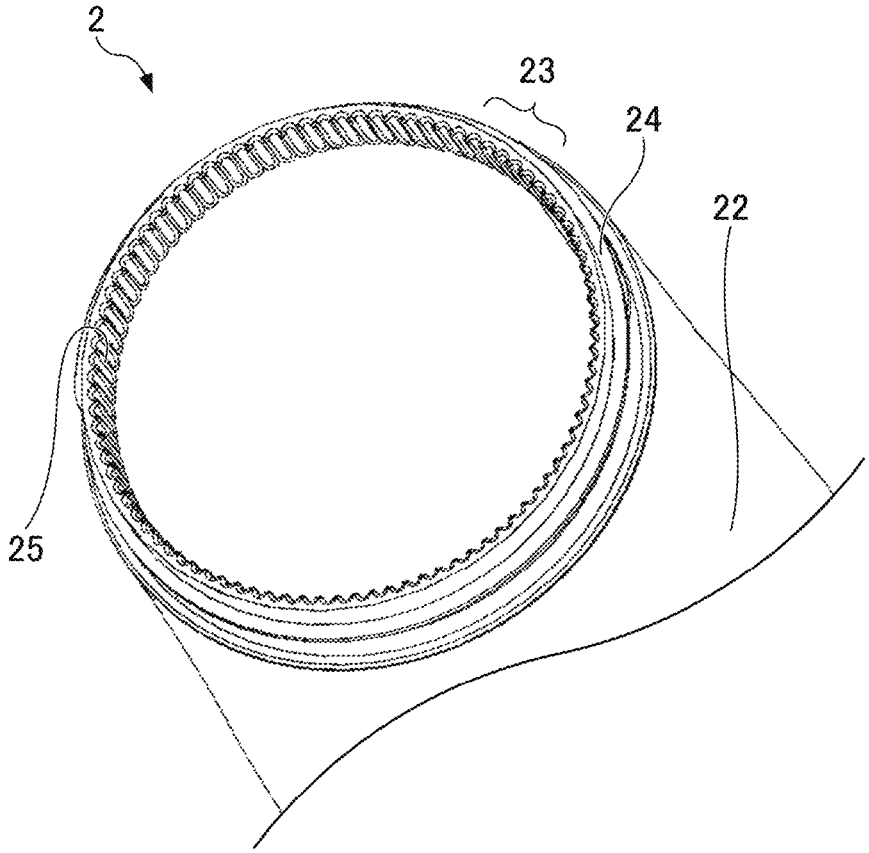
FIG. 8 is an oblique view of an upper end of an outer container and its surroundings.

FIG. 8 is an enlarged oblique view of the upper part of the outer container 2. As illustrated in FIGS. 4 and 8, the outer container 2 has the bottom 21 and the side wall 22.

The upper end of the side wall 22 is the upper-end thin side wall 23 reduced on the outer side, and the upper-end thin side wall 23 is provided with the screw threads 24 on the outer surface, and with the jagged surface 25 on the inner circumferential surface, recesses and projections extending in the longitudinal direction being repeatedly provided in the jagged surface. The jagged surface 25 is a rotation restricting part of the outer container 2. The rotation restricting part provided on the inner surface of the outer container 2 may be structured in any other form, and, for example, liner ribs or liner slits may be provided in a less number, or the top-view shape may be a polygonal shape.

(Engaging Structure)

Figure 9:
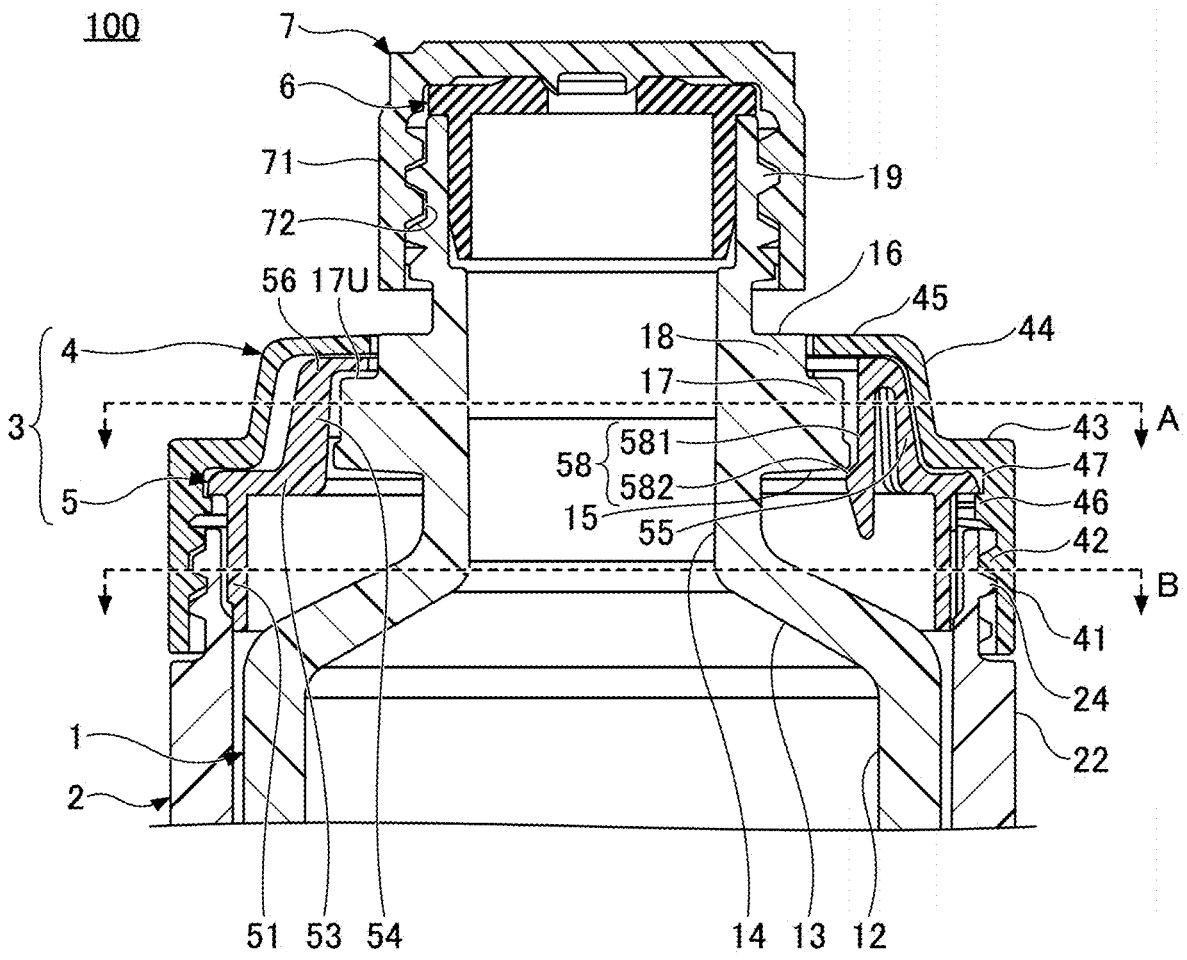
FIG. 9 is an enlarged cross-sectional view of the mouth part of the double container of the present invention and its surroundings.
Figure 10:
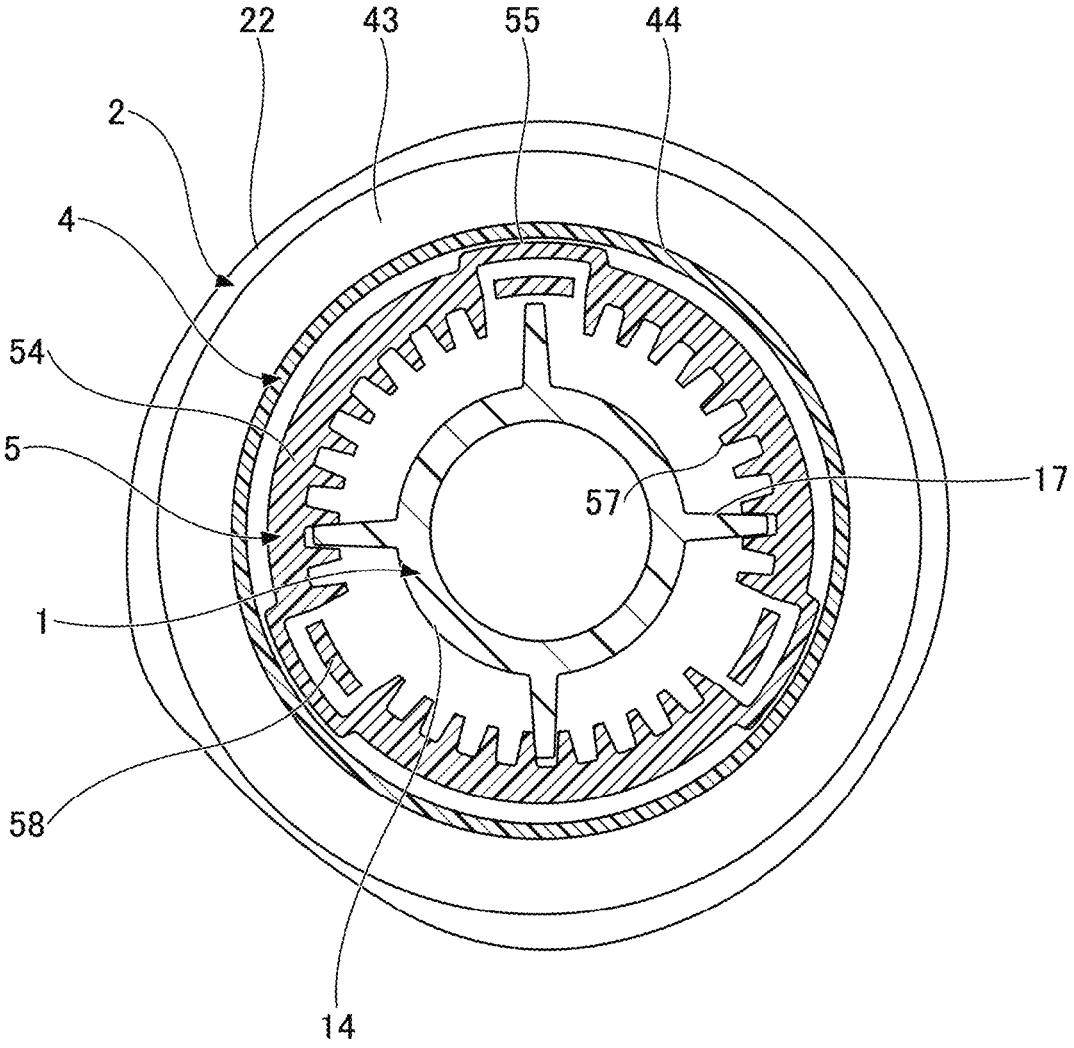
FIG. 10 is a cross-sectional view illustrating engagement of the inner container with the connecting part in the double container according to the present invention.
Figure 11:
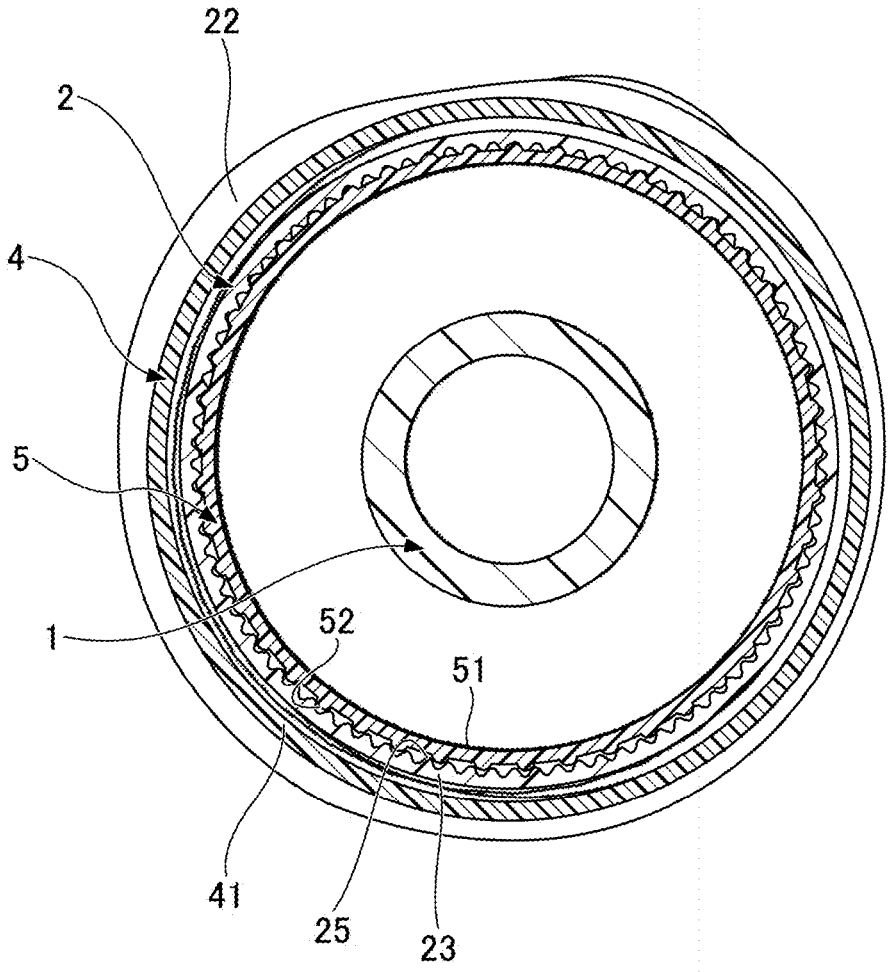
FIG. 11 is a cross-sectional view illustrating engagement of the outer container with the connecting part in the double container according to the present invention.

FIG. 9 is an enlarged cross-sectional view of the mouth part of the double container 100 of the present invention and its surroundings. FIG. 9 is an enlarged view of the region X denoted by the dashed line in FIG. 3. FIG. 10 is a cross-sectional view illustrating engagement between the inner container 1 and the connecting part 3, and is a cross-sectional view along the surface A illustrated in FIGS. 3 and 9. FIG. 11 is a cross-sectional view illustrating engagement between the outer container 2 and the connecting part 3, and is a cross-sectional view along the surface B illustrated in FIGS. 3 and 9.

As illustrated in FIG. 9, in the assembled state, the engagement is established such that the upper surface of the upper-end ring 45 of the first connecting member 4 is positioned substantially on the same plane as the upper surface of the upper flange 16 of the mouth part 14 of the inner container 1. Specifically, the upper-end ring 45 of the first connecting member 4 and the upper-end diameter-reducing ring 56 of the second connecting member 5 are positioned so as to overlap the rib top 17U, which is the step of the mouth part 14. Here, the inner rim of the upper-end ring 45 faces the outer rim of the upper flange 16, and the inner rim of the upper-end diameter-reducing ring 56 faces the outer end of the upper rib 18.

Therefore, in the assembled state in which the inner container 1 and the outer container 2 are connected via the connecting part 3, the user can use the assembled double container 100 without any discomfort because there are few recesses or projections exposed to the outside.

Here, as illustrated in the cross-sectional view of FIG. 10, in the assembled state, the lower ribs 17 of the inner container 1 are engaged while being fitted in between the plurality of plate-shaped inner ribs 57 of the second connecting member 5. As a result, the second connecting member 5 is engaged with the inner container 1 such that it cannot rotate relative to the inner container.

In addition, as illustrated in the cross-sectional view of FIG. 11, in the assembled state, the outer ribs 52 of the fit-in tube 51 of the second connecting member 5 are engaged while being fitted in the recesses in the jagged surface 25 on the inner side of the upper-end thin side wall 23 of the outer container 2. As a result, the second connecting member 5 is engaged with the outer container 2 while being restricted from rotation relative to it.

In the assembled state, by the second connecting member 5 being engaged as illustrated in FIGS. 10 and 11, the inner container 1 is restricted from rotation relative to the outer container 2.

As illustrated in FIG. 9, screw threads 72 are formed on the inner surface of a circumferential wall 71 of the cap 7, and the cap 7 is attachable to the inner container 1 by being threadedly engaged with the screw threads 19 formed on the outer circumferential surface of the inner container 1 above the mouth part 14.

Only the first connecting member 4 of the connecting part 3 of the present invention can suffice in connecting the outer container 2 and the inner container 1. However, with provision of the second connecting member 5, the inner container 1 is restricted from rotation relative to the outer container 2 because the second connecting member 5 is restricted from rotation relative to both of the outer container 2 and the inner container 1 as illustrated in FIGS. 10 and 11.

Thus, when the cap 7 is rotated relative to the mouth part 14, the inner container 1 does not rotate relative to the outer container 2. That is, with the double container 100, conjunctive rotation of the cap 7 and the inner container 1 can be inhibited when the cap 7 is opened or closed.

(Assembly of Double Container)

Next, replacement of refills will be described with reference to FIGS. 12 to 15.

Figure 12:
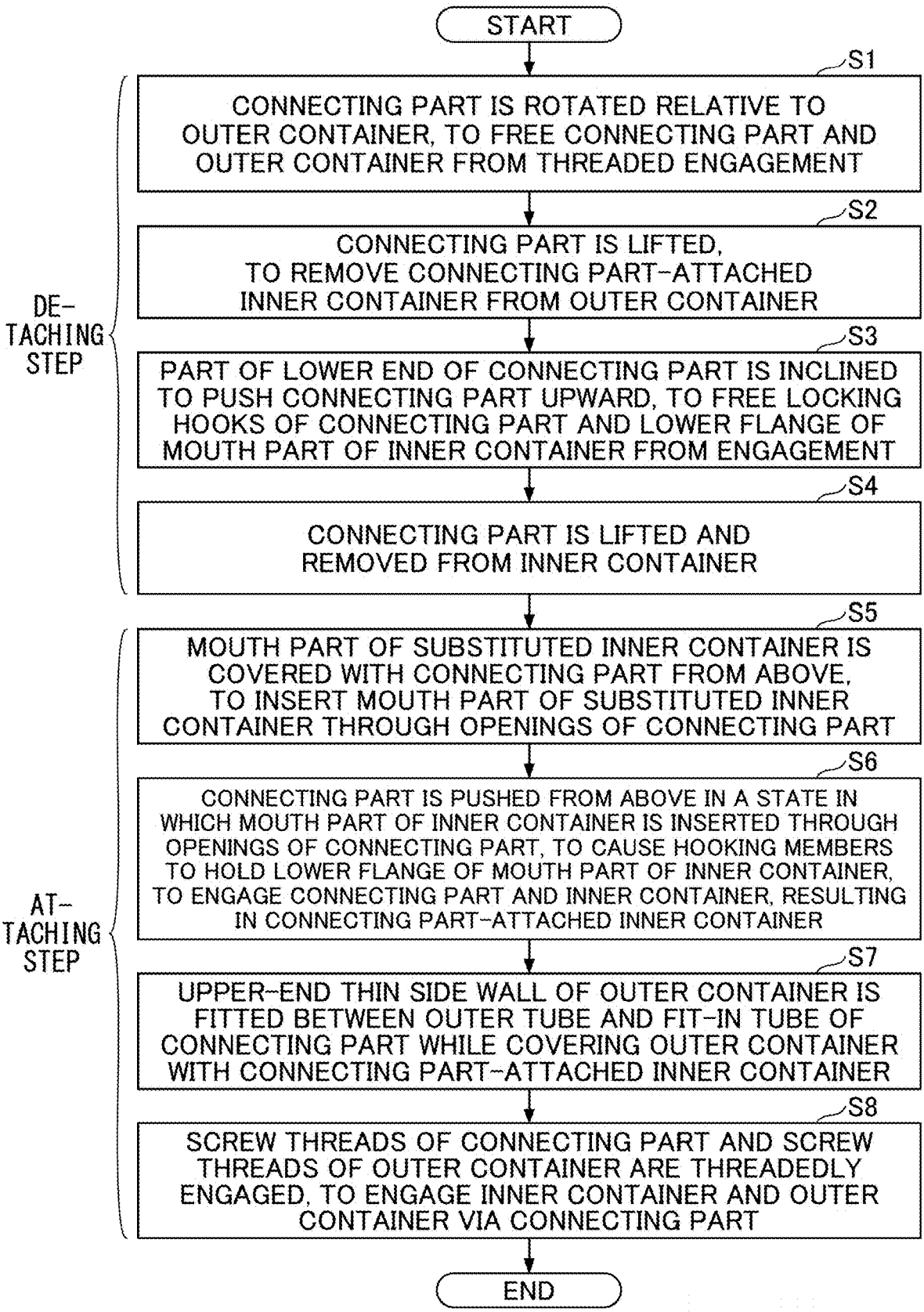
FIG. 12 is a flowchart of refill replacement with the double container according to the present invention.
Figure 13:
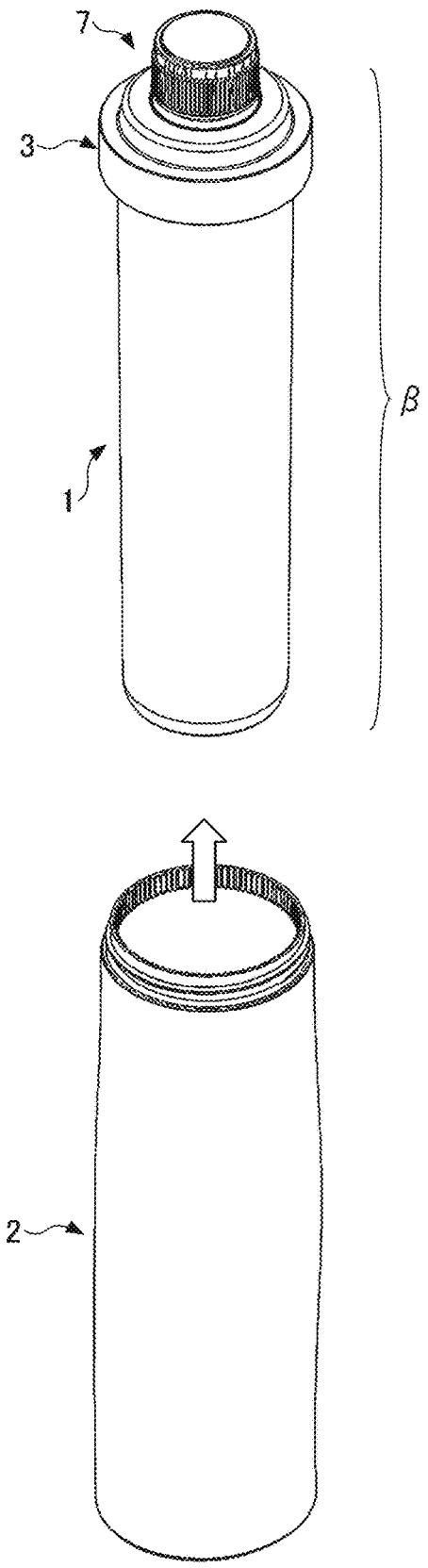
FIG. 13 is a view illustrating removal of a connecting part-attached inner container from the outer container.
Figure 14:
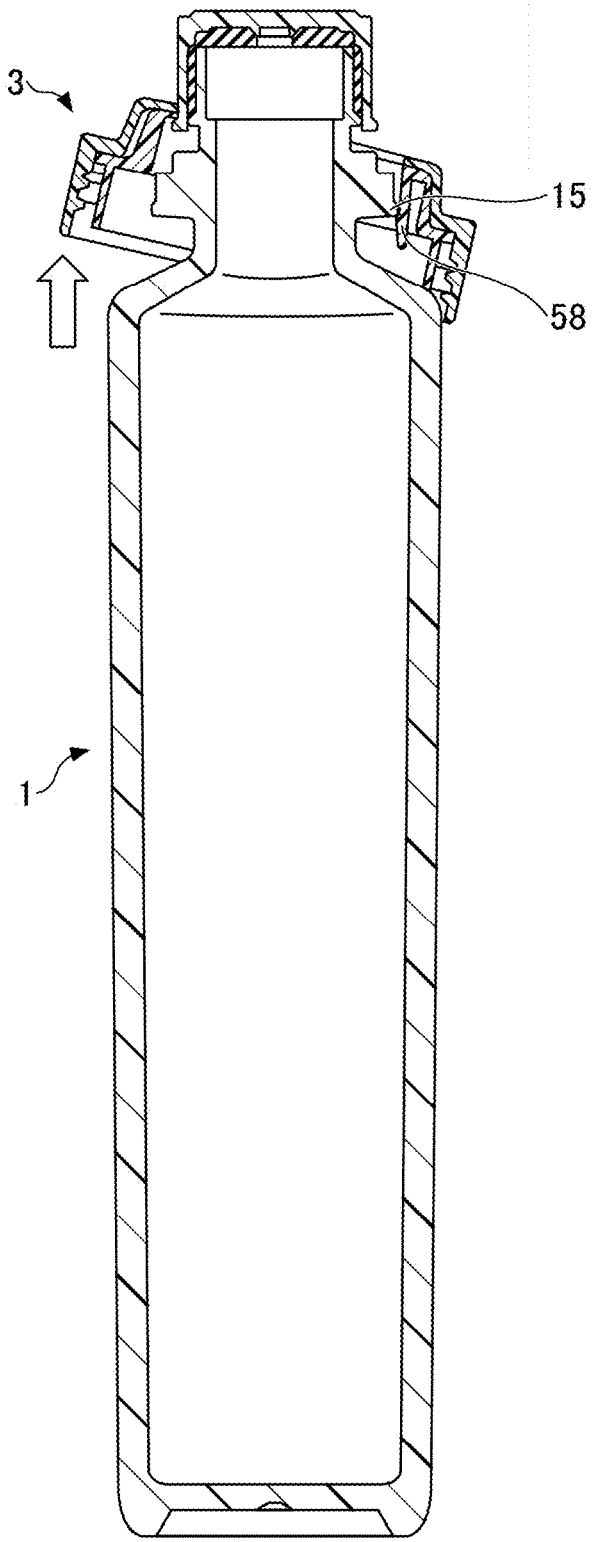
FIG. 14 is a view illustrating removal of the connecting part according to the present invention from the inner container.
Figure 15:
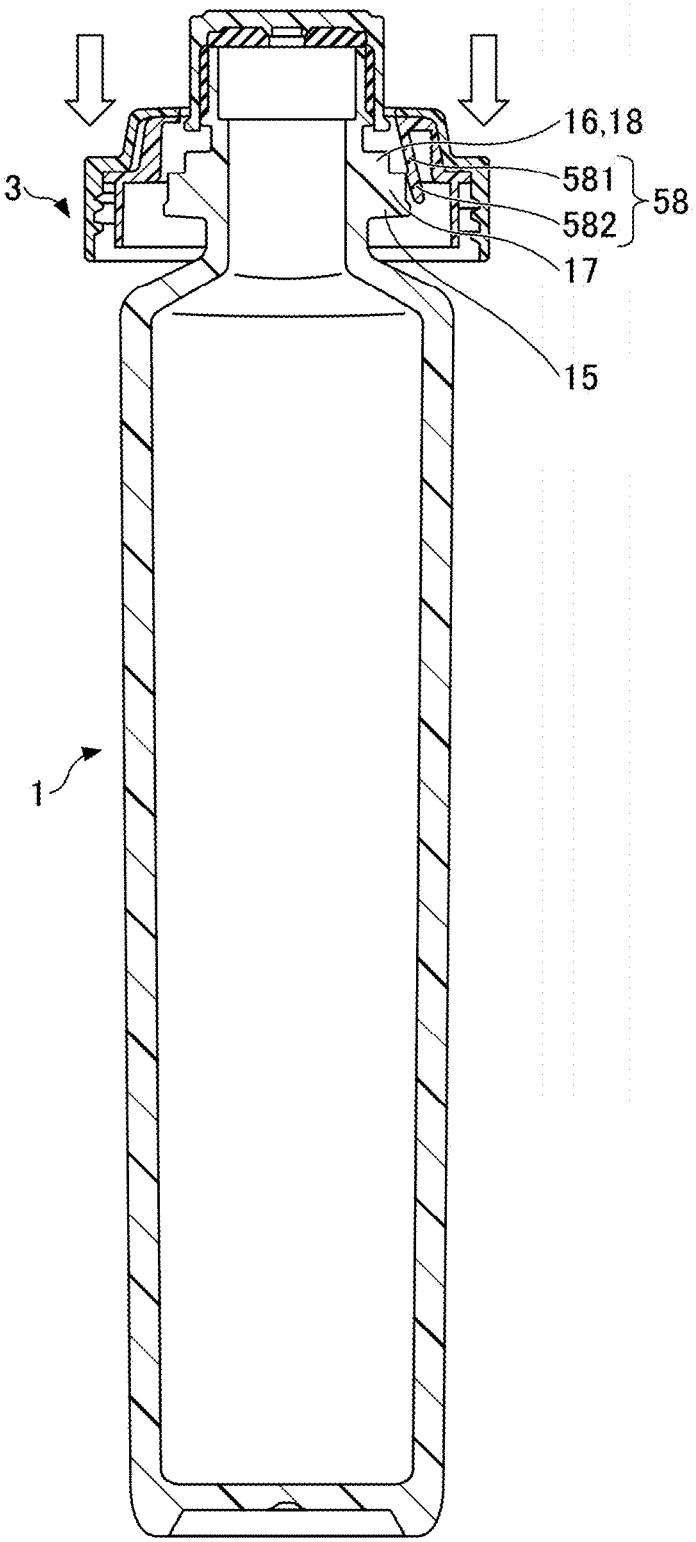
FIG. 15 is a view illustrating attaching of the connecting part according to the present invention to the inner container.

FIG. 12 is a flowchart of the replacement of refills in the double container of the present invention. FIG. 13 is a view illustrating removal of a connecting part-attached inner container β from the outer container 2. FIG. 14 is a cross-sectional view illustrating removal of the connecting part 3 of the present invention from the inner container 1. FIG. 15 is a cross-sectional view illustrating attaching of the connecting part 3 of the present invention to the inner container 1.

The first connecting member 4 and the second connecting member 5 are previously engaged as a state before being put on sale, and the connecting part 3 is in a disassemblable state.

When replacing the current inner container with a new refill since the content has decreased, the connecting part 3 is first rotated relative to the outer container 2 in the step S1 to free the connecting part 3 and the outer container 2 from threaded engagement (i.e., to free the screw threads 42 of the first connecting member 4 and the screw threads 24 of the outer container 2 from engagement).

In the step S2, the connecting part 3 is lifted to remove the connecting part-attached inner container β from the outer container 2. The state in the step S2 is illustrated in FIG. 13.

In the step S3, the connecting part 3 is pushed upward with a force applied to a part thereof, to free the locking hooks 58 of the connecting part 3 from engagement with the position restricting part (lower flange 15) of the inner container, one by one. The state in the step S3 is illustrated in FIG. 14. Since the locking hooks 58 are elastically deformable outward, as illustrated in FIG. 14, disengagement of one of the locking hooks 58 from the lower flange 15 by application of the force to the part of the connecting part 3 causes the other locking hooks 58 to be disengaged one after another.

In the step S4, the connecting part 3 is lifted and removed from the inner container 1 having no remaining content or a low remaining content.

In the step S5, while covering an inner container 1 (cap-attached inner container), which is a substituted refill, with the connecting part 3 from above the inner container, the mouth part 14 of the substituted inner container 1 is inserted through the openings O2 and O3 of the connecting part 3.

In the step S5, in the state in which the mouth part 14 of the substituted inner container 1 is inserted into the openings O2 and O3 of the connecting part 3, the locking hooks 58 and the lower flange 15 of the inner container 1 are engaged, to thereby engage the connecting part 3 and the inner container 1.

In the step S6, in the state in which the mouth part 14 of the inner container 1 is inserted into the openings O2 and O3 of the connecting part 3, the connecting part 3 is pushed downward to engage the locking hooks 58 and the lower flange 15 of the inner container 1. As a result, the connecting part 3 and the inner container 1 are engaged.

In the step S7, while covering the outer container 2 with the connecting part 3 of the connecting part-attached refill container, the upper-end thin side wall 23 of the outer container 2 is fitted between the outer-side outer tube 41 and the inner-side fit-in tube 51 of the connecting part 3.

In the step S8, the screw threads 42 of the first connecting member 4 and the screw threads 24 of the outer container 2 are threadedly engaged to complete the engagement between the inner container 1 and the outer container 2 via the connecting part 3.

By the screw threads 24 of the outer container 2 and the screw threads 42 of the first connecting member 4 being threadedly engaged in the step S8, the distance between the outer tube 41 and the inner-side fit-in tube 51 becomes short in the connecting part 3, and the jagged surface 25 of the outer container 2 and the outer ribs 52 of the second connecting member 5 are engaged. In the state in which the connecting part 3 is threadedly engaged with the outer container 2 by this engagement, the connecting part 3 is restricted from rotation relative to the outer container 2.

When removing the connecting part 3 from the inner container 1 in the step S2, a force is applied upward to a part of the connecting part 3 as illustrated in FIG. 14. Here, a locking hook 58 on the side where no force is applied deforms to be kept engaged with the lower flange 15, while one locking hook 58 on the side where the force is applied is disengaged from the lower flange 15, thereby freeing the locking hooks 58 from the engaged state in order. In this way, the connecting part 3 is removed.

On the other hand, when engaging the connecting part 3 with the inner container 1 in the step S6, as illustrated in FIG. 15, a force is applied uniformly to the connecting part 3 from above. Here, the plurality of locking hooks 58 gets pushed while spreading uniformly by having contact with the outer rim of the upper flange 16 and the plate-shaped ribs 18 and 17. When the locking projections 582 reach the bottom of the lower flange 15, as illustrated in FIG. 9, while the portions of the lower surface of the upper-end diameter-reducing ring 56 where the locking hooks 58 are not provided and the rib tops 170 are having contact with each other, the locking projections 582 become hooked on the lower end of the outer rim of the lower flange 15. By the locking hooks 58 holding the lower flange 15, the connecting part 3 becomes engaged with the inner container 1.

By changing how to apply the force, it is possible to easily attach or detach the locking hooks 58 of the second connecting member 5 to or from the lower flange 15, which is the position restricting part of the inner container 1, making it possible to repeatedly attach or detach the connecting part 3 to or from the inner container 1.

Therefore, in the double container according to the present invention, the inner container can serve as a refill that can be replaced, together with its content, with respect not only to the outer container but also to the connecting part made of the first connecting member and the second connecting member.

Therefore, the connecting part can also be removed from the inner container and reused repeatedly together with the outer container. Therefore, there are more parts that can be reused, and it is possible to reduce resin loss. Therefore, the double container according to the present invention can inhibit conjunctive rotation of the cap and the inner container while minimizing the amount of resins used in the refill inner container.

Although the preferred embodiment of the present invention has been described in detail above, the present invention is not limited to the specific embodiment, and various changes and modifications are applicable within the scope of the spirit of the embodiment of the present invention described in the claims.

The present international application claims priority to Japanese Patent Application No. 2022-022377 filed Feb. 16, 2022, and the entire contents of 2022-022377 are incorporated herein by reference.

REFERENCE SIGNS LIST

| | |
|---|---|
| 1 | inner container (refill container) |
| 2 | outer container |
| 3 | connecting part |
| 4 | first connecting member |
| 5 | second connecting member |
| 6 | inner plug |
| 7 | cap |
| 10 | bottle body |
| 11 | bottom |
| 12 | trunk |
| 13 | shoulder part |
| 14 | mouth part |
| 15 | lower flange (position restricting part) |
| 16 | upper flange (intrusion inhibiting member) |
| 17 | lower rib (mouth part rotation restricting part) |
| 17U | rib top (position restricting part) |
| 18 | upper rib |
| 19 | screw thread |
| 21 | bottom |
| 22 | side wall |
| 23 | upper-end thin side wall |
| 24 | screw thread |
| 25 | jagged surface (rotation restricting part) |
| 41 | outer tube |
| 42 | screw thread |

-continued

| REFERENCE SIGNS LIST | |
|---|---|
| 43 | outer annular plate |
| 44 | upright tube |
| 45 | upper-end ring |
| 46 | annular projection |
| 47 | fitting groove |
| 51 | fit-in tube |
| 52 | outer rib (outer-circumference rotation restricting part) |
| 53 | annular support plate |
| 54 | upright tube |
| 55 | diameter-increasing region |
| 56 | upper-end diameter-reducing ring |
| 57 | inner rib (inner-circumference rotation restricting part) |
| 58 | a plurality of locking hooks |
| α | refill |
| β | connecting part-attached inner container |

The invention claimed is:

1. A double container, comprising:

an inner container including a mouth part and a shoulder part;

an outer container having a side wall, the outer container being configured to accommodate the inner container in a replaceable manner;

a first connecting member having a two-stage tube shape, the first connecting member having an opening through which the mouth part of the inner container can be inserted, and the first connecting member being configured to be threadedly engaged with an outer surface of the side wall of the outer container while covering the shoulder part of the inner container and an upper end of the side wall; and a second connecting member having an approximately tube shape, the second connecting member having an opening through which the mouth part of the inner container can be inserted, and the second connecting member being situated on an inner side of the first connecting member, wherein the second connecting member comprises:

an inner-circumference rotation restricting part configured to contact a part of the mouth part of the inner container to restrict rotation relative to the mouth part; and an outer-circumference rotation restricting part configured to contact a part of the side wall of the outer container to restrict rotation relative to the outer container, and in an assembled state, the inner container is restricted from rotation relative to the outer container.

2. The double container according to claim 1, wherein the second connecting member includes a fit-in tube, the outer-circumference rotation restricting part being formed on an outer surface of the fit-in tube, the outer container includes a rotation restricting part that is provided on an inner surface of the side wall, when the inner container and the outer container are connected, the side wall of the outer container is fitted between: a part of the first connecting member, the first connecting member being on an outer side; and the fit-in tube of the second connecting member that is situated on the inner side, after the outer container and the first connecting member are threadedly engaged, the rotation restricting part on the inner surface of the side wall of the outer container and the outer-circumference rotation restricting part of the fit-in tube of the second connecting member are engaged, thereby restricting the second connecting member from rotation relative to the outer container.

3. The double container according to claim 2, wherein the outer-circumference rotation restricting part of the fit-in tube of the second connecting member is a linear rib, and the rotation restricting part on the side wall of the outer container is a jagged inner surface in which a recess and a projection extending in a longitudinal direction are repeatedly provided.

4. The double container according to claim 1, wherein a cap having a screw thread on an inner circumferential surface thereof is attachable to the double container by the cap being threadedly engaged with a screw thread formed on an outer circumferential surface of the inner container above the mouth part, and when the cap is rotated relative to the mouth part, the inner container is restricted from rotation relative to the outer container.

5. The double container according to claim 1, wherein the second connecting member is repeatedly attachable to and detachable from the inner container, and the inner container, together with its content, serves as a replaceable refill with respect to the outer container, to the first connecting member, and to the second connecting member.

6. The double container according to claim 5, wherein the mouth part of the inner container includes a position restricting part that is located on an outer side of an outer circumferential surface of the mouth part, the second connecting member includes a plurality of locking hooks that are suspended in a cantilever-like manner from an inner rim of an upper end of the two-stage tube shape, the locking hooks having an outward spring property, a locking projection projecting inward is formed on a lower end of an inner side of each of the locking hooks, and the plurality of locking hooks are elastically deformed such that the locking projection holds and engages with the position restricting part of the mouth part, thereby causing the second connecting member to be engaged with the mouth part of the inner container while being restricted relative to the mouth part in a vertical direction.

7. The double container according to claim 6, wherein the position restricting part of the mouth part of the inner container includes:

a lower flange extending outward from the outer circumferential surface of the mouth part; and an upper end surface of a mouth part rotation restricting part that is provided upright so as to be continuously joined with an upper surface of the lower flange, the second connecting member includes an upright tube, the inner-circumference rotation restricting part being provided on an inner circumferential surface of the upright tube, and when the inner-circumference rotation restricting part of the second connecting member and the mouth part rotation restricting part are engaged with each other, the second connecting member is restricted from rotation relative to the inner container.

8. The double container according to claim 7, wherein the inner-circumference rotation restricting part of the second connecting member includes a plurality of plate-shaped ribs projecting inward from the inner circumferential surface of the upright tube and extending in the vertical direction.

9. The double container according to claim 1, wherein the first connecting member includes:

an outer tube having a screw thread on an inner circumferential surface of the outer tube, the screw thread being able to be threadedly engaged with the outer container;

an outer annular plate extending inward from an upper end of the outer tube;

an upright tube standing upright on an inner rim of the outer annular plate; and an upper-end ring extending inward from a top of the upright tube, the mouth part has an upper flange above a position at which the mouth part engages with the second connecting member, and in the assembled state, the upper-end ring of the first connecting member and the upper flange of the mouth part are positioned substantially on a same plane.

10. A connecting part for connecting an inner container including a mouth part and an outer container configured to accommodate the inner container in a replaceable manner, the connecting part comprising:

a first connecting member threadedly engageable with the outer container and having an opening that is larger than an outer diameter of the mouth part of the inner container; and a second connecting member having an approximately tube shape and having an opening through which the mouth part of the inner container can be inserted, the second connecting member being situated on an inner side of the first connecting member, wherein the second connecting member comprises:

an inner-circumference rotation restricting part configured to contact a part of the mouth part of the inner container to restrict rotation relative to the mouth part; and an outer-circumference rotation restricting part configured to contact a part of a side wall of the outer container to restrict rotation relative to the outer container, and by the inner container and the outer container being assembled on each other via the connecting part, the inner container is restricted from rotation relative to the outer container.

* * * * *